US007086840B2

(12) United States Patent
Lilie

(10) Patent No.: US 7,086,840 B2
(45) Date of Patent: Aug. 8, 2006

(54) OIL PUMP FOR A RECIPROCATING HERMETIC COMPRESSOR

(75) Inventor: Dietmar Erich Bernhard Lilie, Joinville-SC (BR)

(73) Assignee: Empresa Brasileira De Compressores S.A. - Embraco, Joinville (BR)

( * ) Notice: Subject to any disclaimer, the term of this patent is extended or adjusted under 35 U.S.C. 154(b) by 368 days.

(21) Appl. No.: 10/363,724

(22) PCT Filed: Sep. 5, 2001

(86) PCT No.: PCT/BR01/00113

§ 371 (c)(1),
(2), (4) Date: Oct. 15, 2003

(87) PCT Pub. No.: WO02/20990

PCT Pub. Date: Mar. 14, 2002

(65) Prior Publication Data

US 2004/0052658 A1 Mar. 18, 2004

(30) Foreign Application Priority Data

Sep. 6, 2000 (BR) ..... 0004286

(51) Int. Cl.
*F04B 19/00* (2006.01)
*F04B 53/00* (2006.01)

(52) U.S. Cl. ..... 417/211; 417/61; 417/417

(58) Field of Classification Search ..... 417/415, 417/416, 417, 902, 61, 211; 184/6.28, 26, 184/32; 92/163, 128
See application file for complete search history.

(56) References Cited

U.S. PATENT DOCUMENTS

| | | | | |
|---|---|---|---|---|
| 2,865,559 | A | 12/1958 | Gigler | |
| 4,016,956 | A * | 4/1977 | Karlsson | 184/15.1 |
| 6,499,972 | B1 * | 12/2002 | Yatsuzuka et al. | 417/417 |
| 6,506,032 | B1 * | 1/2003 | Kawahara et al. | 417/417 |
| 6,644,945 | B1 * | 11/2003 | Lilie et al. | 417/571 |
| 6,663,351 | B1 * | 12/2003 | Joo | 417/53 |
| 6,675,388 | B1 * | 1/2004 | Beckmann et al. | 725/136 |
| 6,676,388 | B1 * | 1/2004 | Lee et al. | 417/417 |
| 6,832,899 | B1 * | 12/2004 | Puff et al. | 417/363 |
| 6,926,504 | B1 * | 8/2005 | Howard | 417/417 |

FOREIGN PATENT DOCUMENTS

| | | |
|---|---|---|
| DE | 24 14 961 B1 | 10/1975 |
| EP | 0 638 729 B1 | 2/1995 |
| FR | 850 942 B1 | 12/1939 |
| GB | 759 345 B1 | 10/1956 |
| JP | 09195938 B1 | 7/1997 |

* cited by examiner

*Primary Examiner*—Charles G. Freay
*Assistant Examiner*—Vikansha Dwivedi
(74) *Attorney, Agent, or Firm*—Darby & Darby

(57) ABSTRACT

An oil pump for a reciprocating hermetic compressor comprising a pump body, having a free end immersed in the oil, and an opposite end coupled to the compressor, so as to be driven by the latter in a reciprocating axial movement, said pump body defining at the free end thereof a valve seat, and further lodging a sealing means, which is displaced between a closing position, seated on said valve seat, and an opening position, spaced from said valve seat, said positions resulting from the displacements of approximation and spacing of the pump body in relation to the sealing means therewithin.

14 Claims, 3 Drawing Sheets

OIL PUMP FOR A RECIPROCATING HERMETIC COMPRESSOR

CROSS REFERENCE TO PRIOR APPLICATIONS

This is a U.S. national phase application under 35 U.S.C. §371 of International Patent Application No. PCT/BR01/00113 filed Sep. 5, 2001, and claims the benefit of Brazilian Application No. PI 0004286-2, filed Sep. 6, 2000. The International Application was published in English on Mar. 14, 2002 as International Publication No. WO 02/20990 A1 under PCT Article 21(2).

1. Field of the Invention

The present invention refers to an oil pump construction for a reciprocating hermetic compressor of the type used in small refrigeration appliances, such as refrigerators, freezers, water fountains, etc., particularly applied to a conventional reciprocating compressor or to that type of compressor driven by a linear motor.

2. Background of the Invention

In hermetic compressors for commercial and residential refrigeration, an important factor for the correct operation of the appliance is the adequate lubrication of the components moving relatively to each other. The difficulty in obtaining such lubrication is associated to the fact that the oil must flow upwardly, in order to lubricate said parts with relative movement. Among these known solutions for obtaining such lubrication, there is one using the principles of centrifugal force and mechanical dragging.

In one of these solutions, which is used both in the linear compressors and the reciprocating compressors, in order to supply oil to the piston/cylinder assembly, it is necessary to make the gas flow, at the suction side of the compressor and which generates a small pressure differential in relation to the oil sump, draw said oil through a capillary tube, mixing it with the gas drawn by the compressor, said mixture being admitted to the inside of the cylinder by the suction valve, so that the oil lubricates the contacting parts between the piston and the cylinder. As a function of the low gas flow drawn by the compressor in certain situations, this construction is not always efficient.

In another known construction (WO97/01033), the compression and suction forces of the piston are used to displace the lubricating oil from the sump, through a capillary tube, to an upper reservoir formed around the cylinder, said reservoir being connected to the inside of the cylinder by a plurality of orifices formed in the wall thereof and which serve for admitting oil into the piston-cylinder gap, when the piston is performing the suction movement, and for discharging said oil when the piston is performing the reverse movement. The oil is discharged into a plurality of channels formed in the valve plate of the compressor, further increasing the suction flow and allowing said oil to re-enter the cylinder.

Other known solution (WO 97/01032) uses a resonant mass that reciprocates inside a cavity formed in the external side of the cylinder, said resonant mass drawing oil from the sump while moving to one direction, said oil passing through a tube and through a one-way valve, which allows only the oil to enter said cavity, said cavity being connected to the inside of the cylinder by a plurality of orifices formed in the wall thereof. The oil in said cavity is expelled when the resonant mass moves to the other direction and passes through a one-way valve, which allows only the oil to leave said cavity. Although being functional, this solution is difficult to produce and its construction has many components.

SUMMARY OF THE INVENTION

Thus, it is an object of the present invention to provide an oil pump for a reciprocating hermetic compressor, of low cost and easy construction, which allows to perform an adequate lubrication of the compressor parts with relative movement, without the difficulties presented by the known prior art solutions and without the low efficiency of said solutions.

This and other objects are achieved by an oil pump for a reciprocating hermetic compressor presenting a shell, which defines in the interior thereof an oil sump, and which lodges a cylinder, inside which reciprocates a piston driven by an actuator, said oil pump comprising a tubular pump body, having a free end immersed in the oil, and an opposite end connected to a lubricant oil directing tube, which conducts said oil to the compressor parts with relative movement, said pump body defining, at the free end thereof, a valve seat, and further lodging a sealing means, which is displaced between a closing position, seated on said valve seat, and an opening position, spaced from said valve seat, the opening and closing positions being obtained when the reciprocating movement causes, respectively, a displacement of approximation and spacing of the pump body in relation to the sealing means therewithin.

BRIEF DESCRIPTION OF THE DRAWINGS

The invention will be described below, with reference to the attached drawings, in which.

DESCRIPTION OF THE ILLUSTRATED EMBODIMENTS

Figure 1:
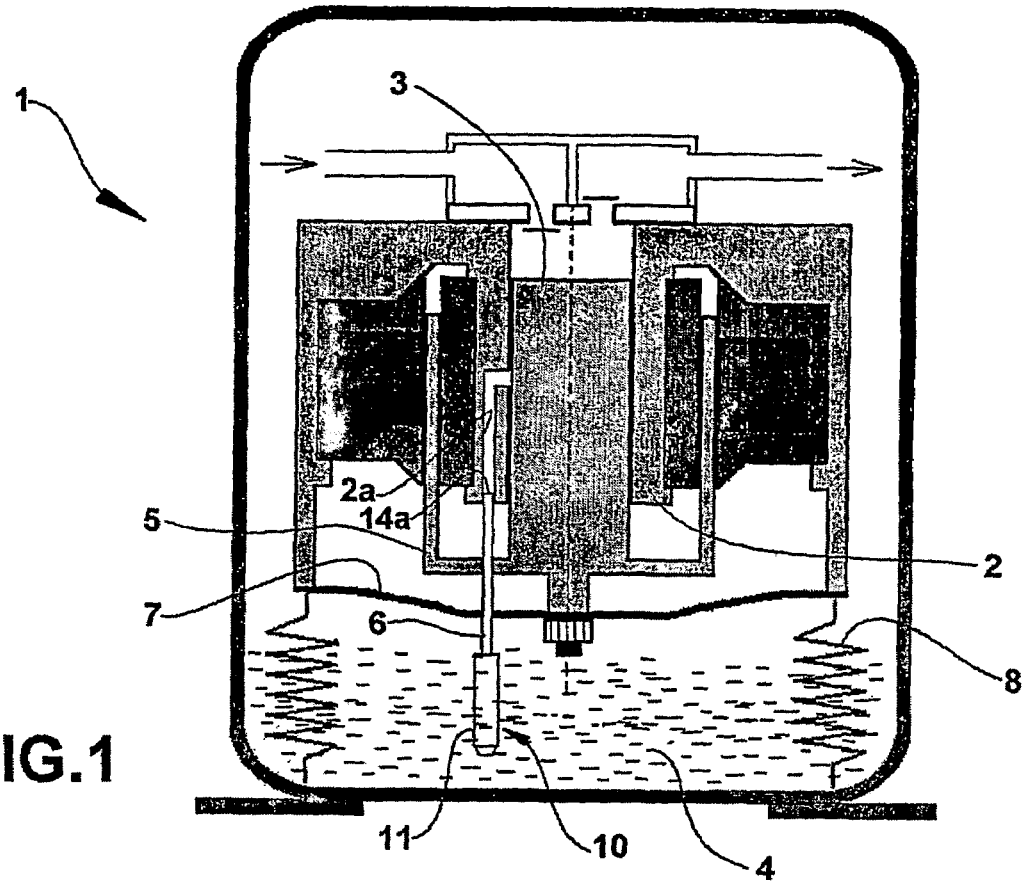
FIG. 1 is a schematic longitudinal diametrical sectional view of part of a reciprocating hermetic compressor with a linear motor, presenting a piston with a vertical axis and having an oil pump constructed according to an embodiment of the present invention.

The present invention will be described in relation to a reciprocating hermetic compressor (for example of the type applied to a refrigeration system) having a shell 1 lodging a cylinder 2, inside which reciprocates a piston 3, inside the shell 1 being defined an oil sump 4, wherefrom the lubricating oil of the movable parts of the compressor parts is pumped by an oil pump 10.

In an illustrated constructive option (FIGS. 1 and 2), the reciprocating hermetic compressor is driven by a linear motor and the piston 3 by an actuator 5.

In other constructive option, to be described ahead (illustrated in FIGS. 4*a*–4*c*), the reciprocating hermetic compressor is of the type driven by a crankshaft 6 that moves the piston 3.

In the reciprocating hermetic compressor with a linear motor, the reciprocating movement of the piston 3 is performed by the actuator 5, which supports a magnetic component driven by the linear motor. The piston 3 is connected to a resonant spring 7 by a connecting rod and forms, with said resonant spring and with the magnetic component, the resonant assembly of the compressor. The non-resonant assembly of the compressor comprises the cylinder 2, a suction and a discharge system and its linear motor.

According to the present invention, the oil pump 10 comprises a tubular pump body 11, having a free end 12 immersed in the oil, and an opposite end 13 connected to a lubricant oil directing tube 14, which conducts oil from the oil sump 4, said oil being pumped by the pump body 11 to the compressor parts with relative movement, particularly between the piston 3 and the internal wall of the cylinder 2.

The pump body 11 is coupled to the compressor, in order to be driven in a reciprocating axial movement caused by operation of said compressor, when the latter vibrates as a function of the mutual reactions of resonance forces, which are related to the oscillating masses therein, with an oscillation amplitude, which is a function of the ratio of the mass of the piston (and aggregated parts thereof) to the mass of the compressor.

The pump body 11 defines in the free end 12 thereof a valve seat 15 and also lodges a sealing means 30, which is displaced between a closing position, seated on said valve seat 15, and an opening position, spaced from said valve seat 15, the opening and closing positions being obtained when the reciprocating movement causes, respectively, a displacement of approximation and spacing of the pump body 11 in relation to the sealing means 20 therewithin.

In the illustrated embodiment, the valve seat 15 is defined in a tapered portion of the pump body 11, adjacent to the free end 12 thereof.

According to the present invention, the oil pump 10 has its pump body 11 coupled to the compressor by means of a lubricant oil directing tube 14.

The actuation of the present oil pump by the compressor occurs, for example, as a function of the oscillating movements of said compressor, such as that resulting from the reaction forces of the resonant assembly. Such oscillating movement is possible, since the compressor is supported by suspension springs.

Figure 2:
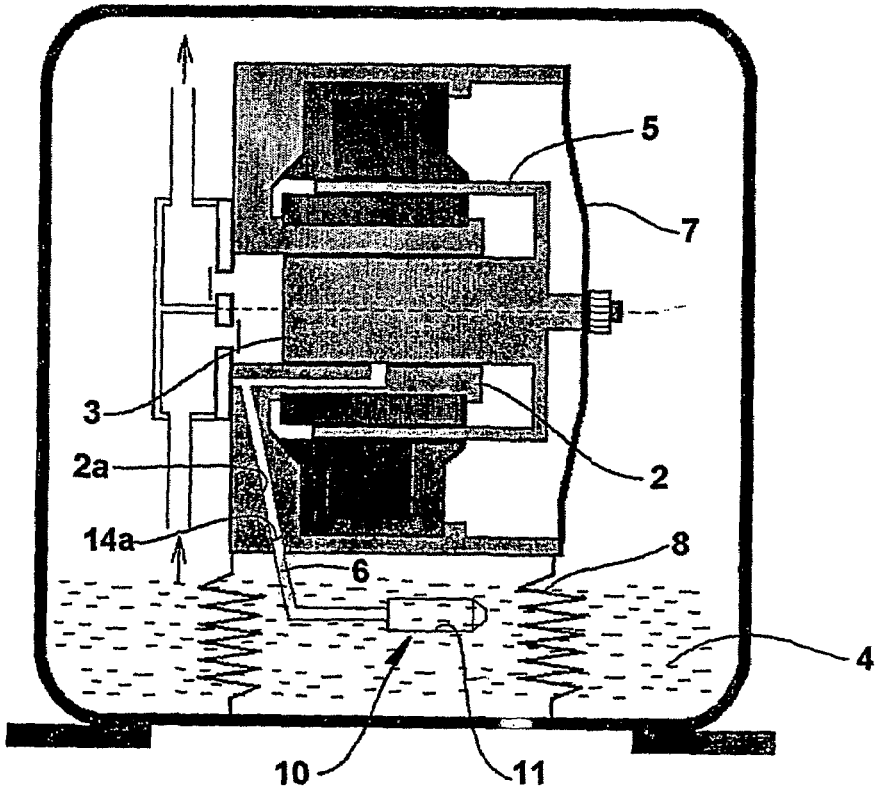
FIG. 2 is a schematic longitudinal diametrical sectional view of part of a reciprocating hermetic compressor with a linear motor, presenting a piston with a horizontal axis, constructed according to the embodiment of the present invention illustrated in FIG. 1.

In the constructions of a hermetic compressor with a linear motor, the lubricant oil directing tube 14 is affixed to the compressor, for example, by interference of one fixing end 14*a* thereof to a channel 2*a* provided in the body of the cylinder 2 (FIGS. 1 and 2) and which usually presents a substantially vertical development (FIG. 1). Nevertheless, said channel 2*a* may have part of its extension substantially horizontal, as it occurs in the constructions having the linear motor with a horizontal axis (FIG. 2).

In the solution of the present invention, the pumping mechanism depends on the inertia effect of the oil contained in the lubricant oil directing tube 14. This oil column generates a flow when the movement is downward and the sealing means 20 avoids, in the upward movement, the oil from flowing out from said lubricant oil directing tube 14.

According to a constructive option of the present invention, illustrated for compressors with a linear motor (FIGS. 1 and 2), the operation and movement of the oil pump is determined, for example, by the reciprocating movement of the compressor inside the shell 1, oscillating according to the oscillating movement of the assembly of springs 8 that support the compressor (FIGS. 1 and 2), in the same oscillating direction of these springs 8. It should be emphasized that this vibration of the compressor results from the mounting thereof to the shell by suspension springs. If the compressor were not mounted inside the shell by springs, such vibrations would not exist.

Figures 4A, 4B:
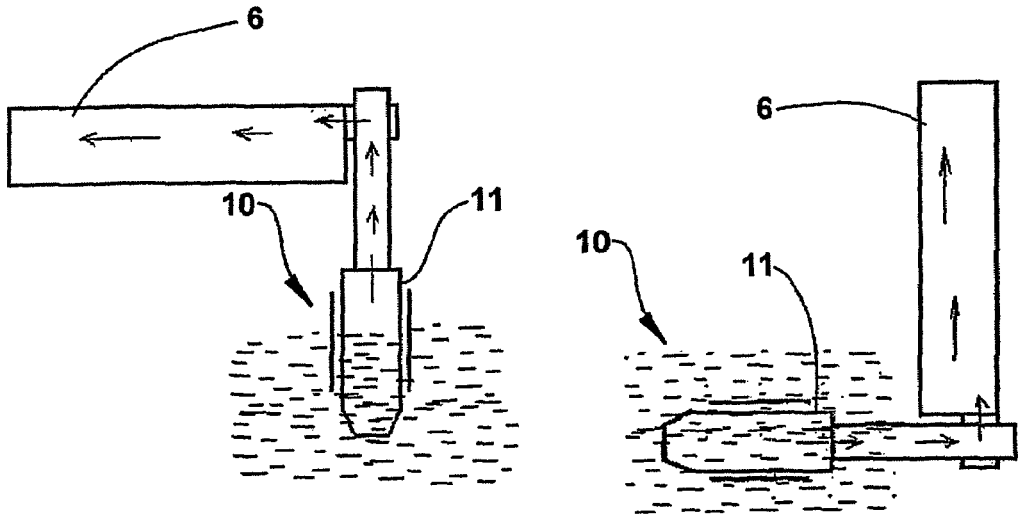
FIGS. 4*a* and 4*b* represent, schematically, two oil pumps of the present invention, which are offset from each other by 90° and affixed to an eccentric of a crankshaft of a reciprocating hermetic compressor.

In the constructions in which the reciprocating compressor has a crankshaft 6 (FIGS. 4*a* to 4*c*), the movement and operation of the oil pump of the present invention is determined, for example, by movement of said crankshaft 6 (FIGS. 4 to 4*b*). In this case, the lubricant oil directing tube 14 is eccentrically affixed to the eccentric of the crankshaft 6, orthogonal to the axial axis thereof, such that the rotation of the crankshaft 6 results, during operation of the compressor, in an axial displacement of the present oil pump, spacing from and approximating to the oil sump 4.

In the illustrated constructions, the lubricant oil directing tube 14 comprises a tubular extension, which is affixed, by a receiving end 14*b*, to an adjacent end of the pump body 11, opposite to that end immersed in the lubricating oil with the fixing end 14*a* thereof coupled to the compressor.

Figures 3A, 3B, 3C:
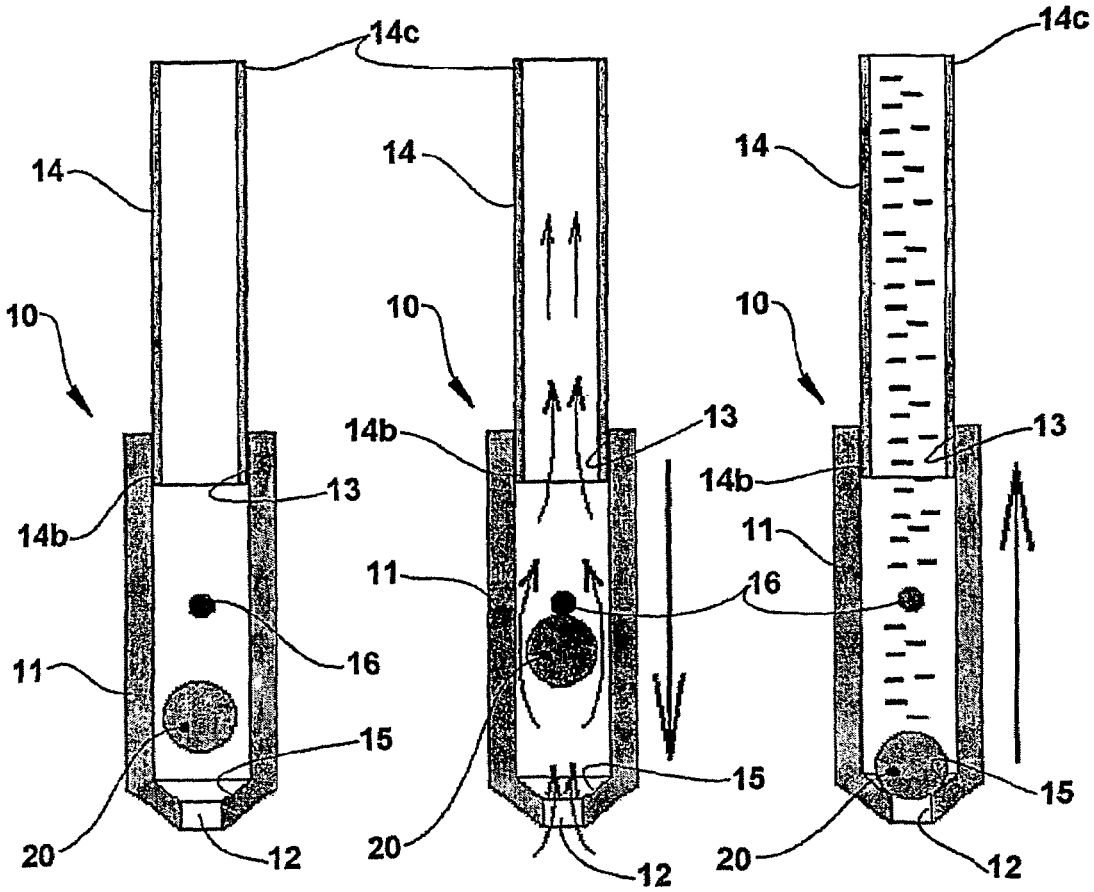
FIGS. 3*a*, 3*b* and 3*c* represent, schematically, the operation of the oil pump of the present invention illustrated in FIG. 1.

According to a constructive form of the present invention, illustrated in FIGS. 3*a*–3*c*, the sealing means 20 is a floating element, for example presenting a substantially spherical contour, which is provided inside the pump body 11 and floats between the valve seat 15 and a position inside the pump body 11 spaced from said valve seat 15, as a function of the movement of the compressor element that actuates the displacements of the sealing means 20.

In the illustrated constructive options, the spacing displacement of the sealing means 20 in relation to the valve seat 15 is limited by a stop means, which is defined inside the pump body 11 spaced from said valve seat 15.

In an illustrated construction (FIGS. 3*a* to 3*c*), the stop means is defined, for example, by a radial projection 16, internal to the pump body 11 and positioned at a determined distance from the valve seat 15 thereof, and occupying, at minimum, a certain extension transversal to the longitudinal axis of said pump body 11, sufficient to prevent the free and unlimited displacement of the sealing means 20 inside said pump body 11.

The determined distance between the valve seat 15 and the stop means inside the pump body 11 is defined so as to optimize the oil pumping in the compressor.

Figure 5A:
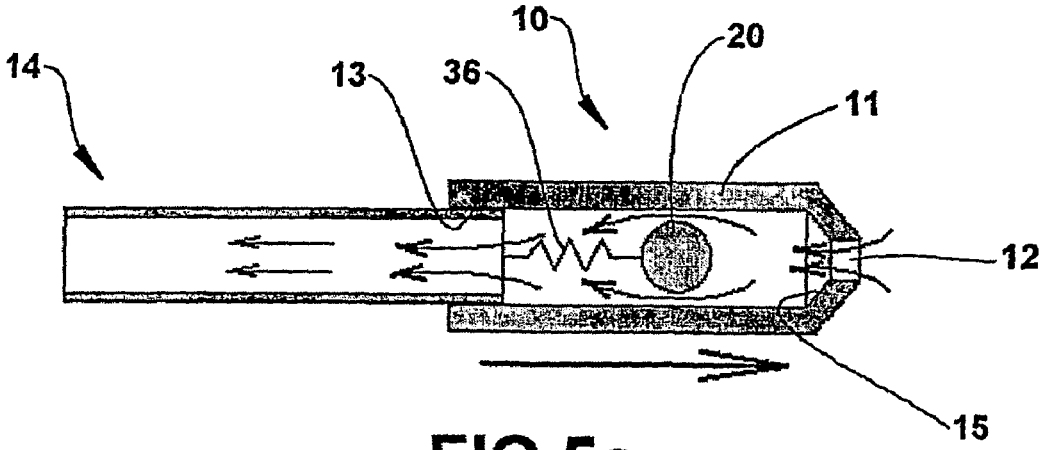
FIGS. 5*a* thru 5*c* represent, schematically, the operation of other constructive form for the oil pump of the present invention, in which said oil pump is in the horizontal position.
Figure 5B:
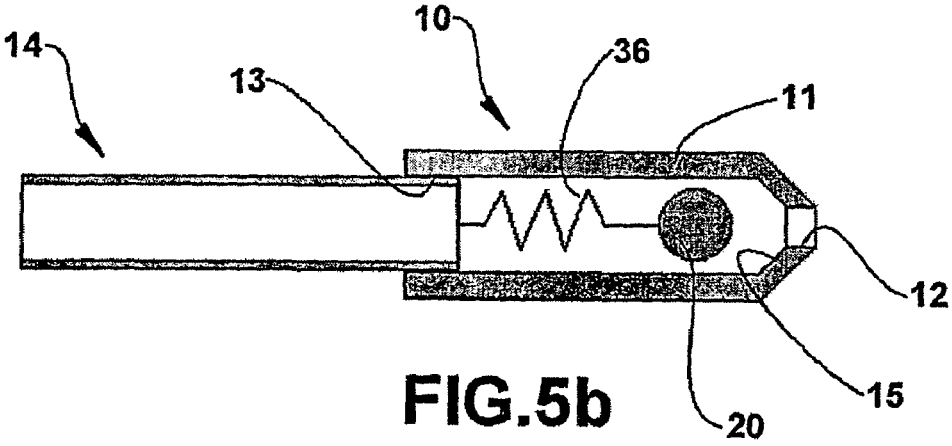
Figure 5C:
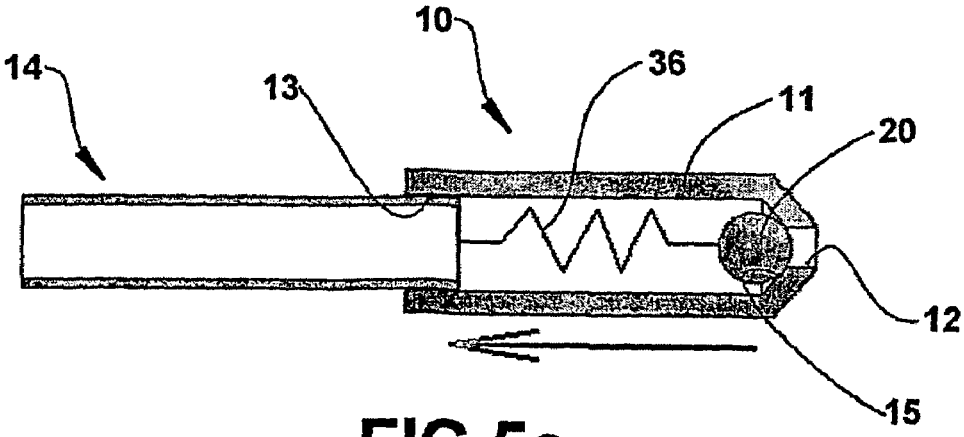

In another embodiment of the present invention illustrated in FIGS. 5*a*–5*c*, the stop means is in the form of a spring element 36 having an end portion mounted to the opposite end 13 of the pump body 11, and another end portion coupled to the sealing means 20, said spring element 36 defining, in a first operative position, the opening position of the sealing means 20, and in a second operative position, the closing position of said sealing means 20.

According to the illustrated embodiment in FIGS. 5*a*–5*c*, the sealing means 20, when in its opening position, presses the spring element 36 to a maximum value that determines the opening limit of said sealing means 20.

In a constructive option, the spring element 36 further presents an inoperative resting position (FIG. 5*b*), intermediate to the first and second operative positions and in which the sealing means 20, when affixed to the other end portion of the spring element 36, remains spaced from the valve seat 15 and prevented from seating on the spring element 36. This inoperative position is obtained when the compressor is not operating.

Although an embodiment with stop means in the form of a spring element 36 mounted in the pump body 11 has been illustrated, it should be understood that said mounting may be effected, for example, in any internal portion of the pump body 11, such as the radial projection 16. It should be further understood that the sealing means 20 may be provided inside the pump body 11, when the stop means is defined by the floating spring element 36, the opening position of the sealing means 20 being obtained by the latter exerting pressure over the spring element 36, resulting from the operation of the compressor.

Although FIGS. 5*a*–5*c* illustrate a construction in which the oil pump of the present invention is horizontal, it should be understood that this embodiment may also be applied to the constructions in which the oil pump 10 is vertical.

The invention claimed is:

1. An oil pump in a reciprocating hermetic compressor presenting a shell, which defines in the interior thereof an oil sump, and which lodges a cylinder, inside which reciprocates a piston, comprising a tubular pump body, having a free end immersed in the oil, and an opposite end connected to a lubricant oil directing tube, which conducts said oil to the compressor parts with relative movement, said pump body being coupled to the compressor, so as to be actuated in a reciprocating axial movement, said pump body defining at the free end thereof a valve seat, and further lodging a sealing means, which is displaced between a closing position, seated on said valve seat, and an opening position, spaced from said valve seat, the opening and closing positions being obtained when the reciprocating movement causes, respectively, a displacement of approximation and spacing of the pump body in relation to the sealing means therewithin.

2. Oil pump, according to claim 1, wherein the fixation of the pump body to the compressor is effected by the lubricant oil directing tube.

3. Oil pump, according to claim 2, wherein the lubricant oil directing tube is affixed to the cylinder.

4. Oil pump, according to claim 3, and in which the compressor is of the reciprocating type having a crankshaft for driving the piston, characterized in that the lubricant oil directing tube is eccentrically affixed to the crankshaft, orthogonal to the axial axis thereof.

5. Oil pump, according to claim 3, and in which the compressor is driven by a linear motor, wherein the movements of the pump body are obtained by vibration of the compressor.

6. Oil pump, according to claim 1, further comprising a stop means, which is provided inside the pump body spaced from the valve seat thereof, and which limits the displacement of approximation and spacing of the pump body in relation to the sealing means therewithin.

7. Oil pump, according to claim 6, wherein the stop means is defined by a radial projection internal to the pump body and positioned at a determined distance from the valve seat thereof.

8. Oil pump, according to claim 1, wherein the stop means is defined by a spring element having an end portion mounted to the pump body, and another end portion coupled to the sealing means, said spring element defining, in a first operative position, the opening position of the sealing means, and in a second operative position, the closing position of the sealing means.

9. Oil pump, according to claim 8, wherein the first operative position the sealing means exerts pressure over the spring element.

10. Oil pump, according to claim 9, c wherein the spring element presents an inoperative position intermediate to the first and second operative positions.

11. Oil pump, according to claim 9, wherein the spring element has the end portion thereof mounted to the opposite end of the pump body.

12. Oil pump, according to claim 9, wherein the spring element has the other end portion thereof mounted to the sealing means.

13. Oil pump, according to claim 1, wherein the sealing means is a floating element provided inside the pump body.

14. Oil pump, according to claim 13, wherein the sealing means is a substantially spherical body.

* * * * *